United States Patent [19]

Kogler et al.

[11] Patent Number: 4,805,963

[45] Date of Patent: Feb. 21, 1989

[54] SHIELD ADVANCING MACHINE

[75] Inventors: Peter Kogler, Knittelfeld; Berthold Scheiber, Zeltweg; Wulf Martin, Grosslobming; Herwig Wrulich, Zeltweg, all of Austria

[73] Assignee: Voest-Alpine Aktiengesellschaft, Linz, Austria

[21] Appl. No.: 914,162

[22] Filed: Oct. 1, 1986

[30] Foreign Application Priority Data

Oct. 14, 1985 [AT] Austria ..... 2972/85

[51] Int. Cl.[4] ..... F21D 9/08

[52] U.S. Cl. ..... 299/33; 299/60

[58] Field of Search ..... 299/33, 56, 61, 71, 299/60

[56] References Cited

U.S. PATENT DOCUMENTS 4,136,910 1/1979 Plummer ..... 299/33
4,199,193 4/1980 Damron et al. ..... 299/31
4,248,481 2/1981 Stoltefuss ..... 299/61
4,688,854 8/1987 Pfeiffer ..... 299/33

FOREIGN PATENT DOCUMENTS 2437669 2/1976 Fed. Rep. of Germany .
1474483 5/1977 United Kingdom .

*Primary Examiner*—Frank T. Yost
*Assistant Examiner*—James L. Wolfe
*Attorney, Agent, or Firm*—Cushman, Darby & Cushman

[57] ABSTRACT

A shield advancing machine, comprising cutting tools (15) rotatably supported on cantilever arms (13, 14) being rotatable around an axis approximately extending in advancing direction and being swivellable in transverse direction to this axis, has a carrier (4) which is guided and supported in axial direction of the shield (1). A rotation drive (22, 33) for a rest (9) of the cantilever arms (13, 14) is provided on the carrier (4), and the cantilever arms (13, 14) as well as their swivel drive (16, 17) are linked to the rest (9).

7 Claims, 2 Drawing Sheets

SHIELD ADVANCING MACHINE

BACKGROUND OF THE INVENTION

1. Field of the Invention

The invention refers to a shield advancing machine comprising cutting tools rotatably supported on cantilever arms being rotatable around an axis approximately extending in advancing direction and being swivellable in transverse direction to this axis.

2. Description of the Prior Art

A shield advancing machine of the initially mentioned type can, for example, be taken from U.S. Pat. No. 4 248 481. In this known construction several cutting arms are supported on the outer side of a central tube, noting that each of these cutting arms is provided with a separate drive means. In this case, there is provided at the outer side of the central tube a toothed wheel extending in circumferential direction and being in meshing engagement with pinions of the drive motors arranged on sliding carriages guided in circumferential direction and having swivellably linked thereto the cutting arms. In this manner, the central tube represents a carrier for the cutting arms performing their working movements. On account of the tubular shape, the swivelling angle of cutting arms being arranged on the outer side of the tube is, however, limited in direction to the center and the cutting forces must, as a whole, be resisted by the guide means of the shifting path of the sliding carriages having swivellably supported thereon the cutting arms. In this known construction, there is arranged within the hollow central tube a further cutting arm, which can be swivelled and which is additionally rotatably supported.

SUMMARY OF THE INVENTION

The invention now aims at providing a device of the initially mentioned type and having a high degree of stability with accompanying low constructional expenditure. The invention further aims at providing a device which provides the possibility to effect cutting work or crushing work, respectively, till near the front edge of the shield without expensive control mechanisms even if shields are used which have an inclined front end. For solving this task, the device according to the invention is essentially characterized in that a carrier is guided and supported on the inner circumference of the shield for being shiftable in axial direction of the shield, in that a rotary drive means for a rest of the cantilever arms is provided on the carrier and in that the cantilever arms as well as the swivel drive means therefor are swivellably linked to said rest. On account of a carrier being guided and supported on the inner circumference of the shield for being shifted in axial direction of the shield, there can be provided a stable construction which requires only little space within the shield. This carrier is directly supported to the shield and can thus easily resist great forces. The rotary drive means for a rest of the cantilever arms is, according to the invention, now provided on this carrier, noting that the cantilever arms as well as the swivel drive means therefor are swivellably linked to the rest itself. Thus, there results a constructively very simple arrangement, by means of which the whole area of the draft face can be covered with an only low number of cutting arms, noting that there are preferably provided on each cantilever arm two cutting heads, preferably having the shape of a mushroom, for rotation around an axis transversely extending relative to the longitudinal axis of the cantilever arms.

The provision of a rotatable rest on a carrier provides now the possibility to swivel or to swivellably support, respectively, the axis of rotation of the rest relative to the longitudinal axis of the shield as this corresponds to a preferred embodiment of the invention. On account of the inclination of said support, the geometry of the swivelling movement of the cutting arms can be adjusted such that any collision with the front edge of the shield can reliably be prevented even if the front edge of the shield does, as seen in an axial section, not vertically adjoin the drift floor. A particularly simple solution for the supporting construction and for the drive means results if the rest of the cantilever arm is designed as a plate member extending in normal direction to the axis of rotation and being rigidly connected with the drive shaft. Such a plate member forming the rest can in a simple manner be supported such that the cutting forces are reliably resisted, for which purpose the drive shaft preferably extends through a swivellable supporting plate being preferably swivellable in transverse relation to the longitudinal axis of the shield and comprising the radial bearing means and the axial bearing means of the drive shaft or the rest, respectively. In this manner, inclinability and adaptability to the geometry of the front edge of the shield is easily to achieve. The drive means itself can be shielded against all cutting forces and be formed of motors of relatively small construction, for which purpose the drive means is formed of motors supported on the supporting plate and having their pinion meshing with a tooth wheel coaxially and non-rotatably coupled to the drive shaft. The tooth wheel, which is non-rotatably and coaxially coupled to the drive shaft, can, in this case, be arranged within a housing supported on the supporting plate. Within this housing there can, if necessary, also be arranged a step-down gearing, noting that in the particularly simple arrangement, in which the pinions of the drive motors are in meshing engagement with the central tooth wheel, a relatively high speed reduction is already obtained in one single step.

For supporting the swivel axes of the cutting arms, the arrangement is advantageously such that the plate-like rest has lateral cheeks extending in essentially parallel relation to the radial direction and having supported thereon the swivel axes of the cantilever arms. In this manner, there is additionally provided a rest of high stability and of relatively low weight, because the lateral cheeks result in stiffening the rest. Advantageously, the swivel axes of the cantilever arms may cross the longitudinal axis of the shield in normal direction, so that cutting work is effected along concentric circles when rotating the rest and if the cantilever arms assume a predetermined swivelled position. In the preferred arrangement, in which are provided two cutting heads having the shape of a mushroom and being supported for rotation transversely relative to the longitudinal axis of the cantilever arms, advancing movement is, like with known partial cut cutting machines, effected essentially in direction of the axis of rotation of the cutting heads, and all advantages with partial cut cutting machines of this type can also be achieved with shield advancing machines.

The swivelling axes of the cutting arm on the rest are located in an off-center position of the axis of rotation, and for obtaining a substantially plane drift face, the radial distances of the swivel axes from the axis of rotation of the rest are different for different cantilever arms. The swivelling angles of both cutting arms can, in this case, be adjusted such that the cutting arm being swivellable around a swivel axis located in closer proximity to the axis of rotation cuts essentially the central area of the drift face, whereas the cutting arm being swivellably supported at a greater radial distance from the axis of rotation of the rest cuts an outer annular area of the mining face.

For making sure that with such an arrangement, in which a free space of course remains between said both cutting heads supported for rotation in transverse relation to the longitudinal axis of the cutting arm and cutting work or crushing work is not effected there, also be cut the partial area of the drift face located in the axis of rotation, the arrangement is advantageously such that the plane described by the geometric longitudinal axis of at least one cantilever arm during swivelling this arm is located at a distance from the axis of rotation of the rest which corresponds to half the free distance between the cutting heads of this cantilever arm. The cutting arm being, as seen in an axial view, laterally displaced is preferably that cutting arm which has located its swivel axis in closer proximity to the axis of rotation of the rest, because it is just this cutting sarm, which is preferred to cut the central area of the drift face.

The inclination of the supporting plate can, in a simple manner, be changed by means of a hydraulic cylinder-piston-aggregate, noting that the axis of rotation is in a preferred manner adjusted such that it extends in normal relation to that straight line which results by connecting, as seen in a vertical longitudinal section of the shield, the upper edge of the shield with its bottom edge. A particularly simple construction results, if said two cantilever arms are arranged on the rest such that their areas of swivelling movement overlap one the other at the drift face.

BRIEF DESCRIPTION OF THE DRAWING

In the following, the invention is further explained with reference to an embodiment shown in the drawing in which.

DETAILED DESCRIPTION OF THE PREFERRED EMBODIMENT

Figure 1:
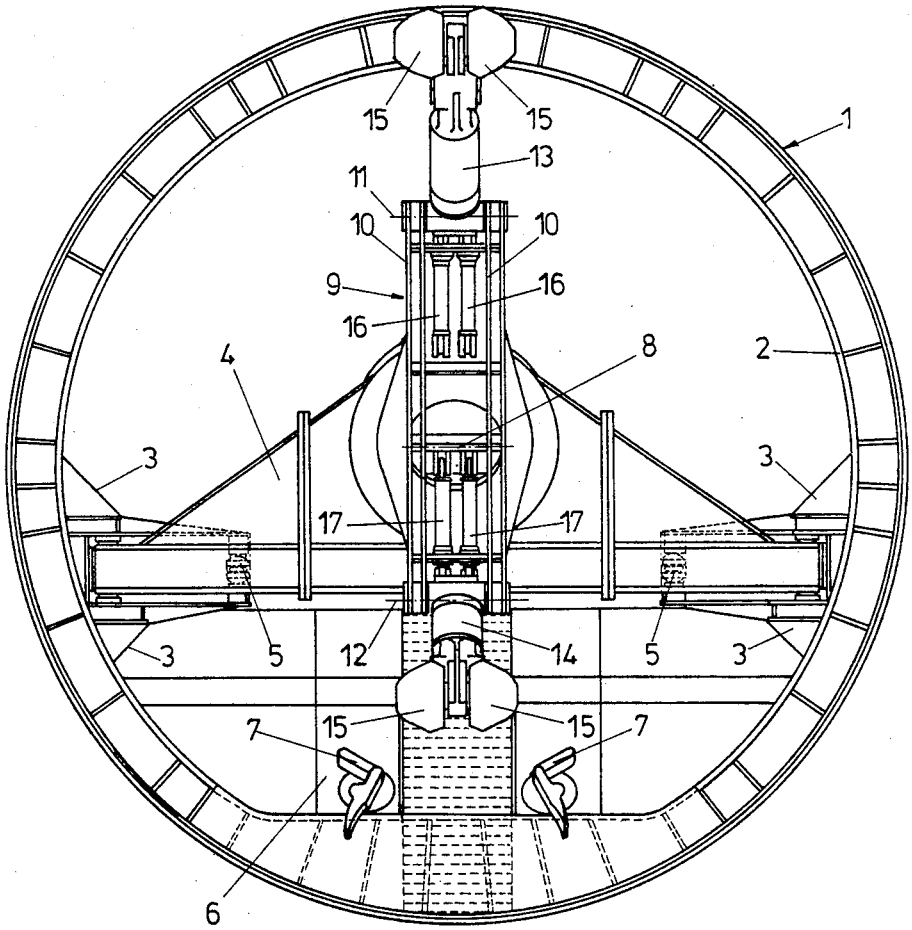
FIG. 1 shows a front elevation of a shield advancing machine in the direction of the arrow I of FIG. 2

In FIG. 1, there is shown a shield 1 being in usual manner positioned within a tunnel. At the inner circumference 2 of the shield 1, there are provided bearing blocks 3, in which a carrier 4 is supported for being shiftable in axial direction of the shield 1. The shifting drive means is formed of hydraulic cylinder-piston-aggregates, the location of engagement of which is schematically indicated by 5.

On the bottom of the shield 1, there is provided a loading means 6 being equipped with lobster grippers 7 which transport the cut material to a removal conveyor means.

A rest 9 of substantially plate-like design is supported on the carrier 4 for being rotatable around an axis 29. The rest 9 further has lateral cheeks 10 on which are supported the swivel axes 11 and 12 of cutting arms. The cutting arms are designated by reference numerals 13 and 14 and carry at their free ends cutting heads 15 rotatably supported for rotation in transverse relation to the longitudinal axis of the respective cutting arms 13, 14.

Hydraulic cylinder-piston-aggregates 16, 17 are provided as a swivel drive for the cutting arms 13, 14.

Figure 2:
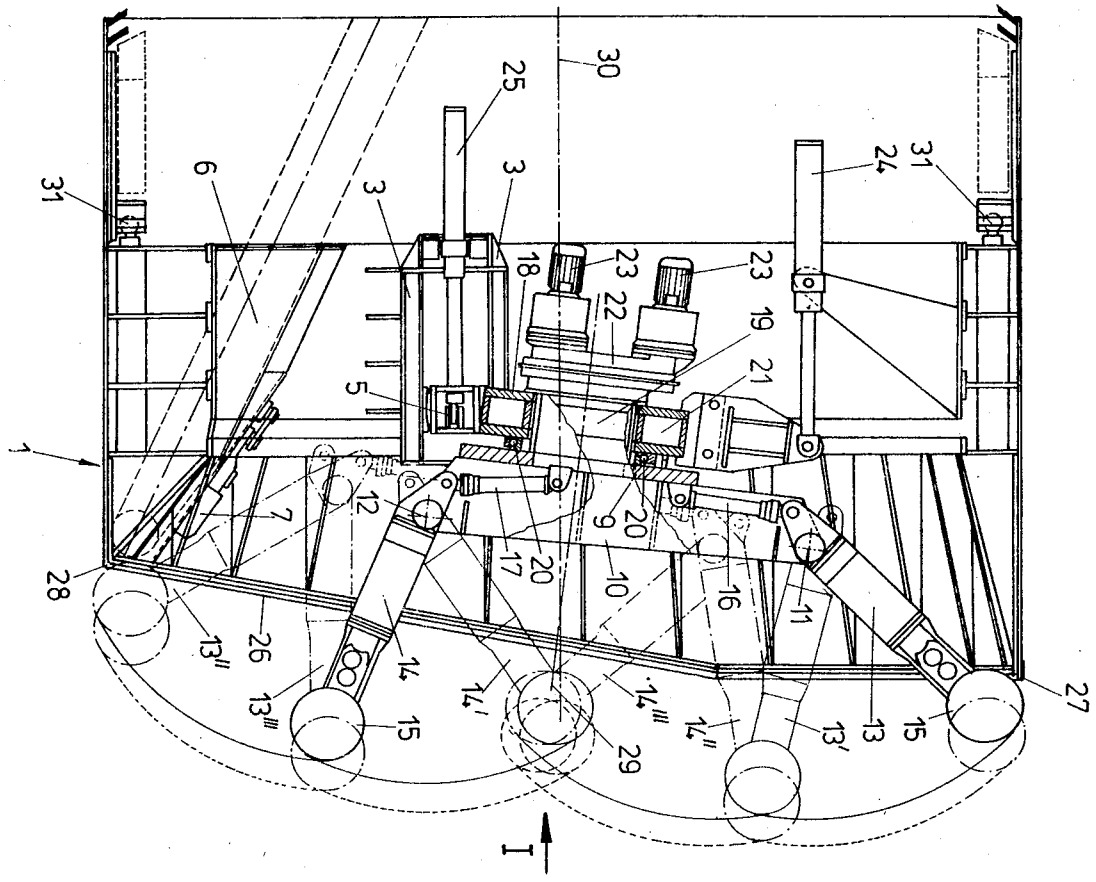
FIG. 2 shows an axial section through the device according to FIG. 1.

As can be taken from the representation of FIG. 2, the rest 9 is supported on a supporting plate 18. The rest 9 is non-rotatably connected with the shaft 19 extending through the supporting plate 18. The rest 9 is supported on the supporting plate with interposition of axial bearings 20, so that the cutting forces can reliably be supported by the supporting plate. The supporting plate 18 carries also the radial bearings 21. The drive shaft 19 for the rest 9 carries at its free end a further disc provided with an external gear and arranged within a housing 22. The drive is derived from motors 23, noting that, in the shown arrangement, there are provided three motors 23 distributed over the circumference of the central tooth wheel located within the interior of the housing 22, the pinions of these motors being in meshing engagement with said toothed wheel. The supporting plate 18 can be adjusted in its inclination by means of a cylinder-piston-aggregate 24. The location 5 of engagement for shifting the carrier 4, which location has already been shown in FIG. 1, is connected with a hydraulic cylinder-piston-aggregate 25.

As can be taken from the representation according to FIG. 2, the front edge 26 of the shield 1 is inclined as seen in an axial section. The supporting plate 18 is, by actuating the hydraulic cylinder-piston-aggregate 24, now adjusted such that it extends, as seen in the section shown in FIG. 2, essentially in parallel relation to the straight line connecting the upper edge 27 with the bottom edge 28 of the front edge 26 of the shield. In this manner, the axis 29 of rotation is inclined relative to the longitudinal axis 30 of the shield and extends essentially in normal relation to this straight line connecting the edges 27 and 28. When now the rest 9 is rotated around the axis 29 of rotation, there result various possibilities for the cutting heads 15 performing cutting work, noting that various possible swivelled positions are separately shown. The swivel axis, being designated by 12, of the cutting arm 14, is located in closer proximity to the axis of rotation than the swivel axis 11 of the cutting arm or cantilever arm 13, respectively. When swivelling the cutting arm 13 by actuating the hydraulic cylinder-piston-aggregate 16, the cutting arm 13 can arrive at the position 13'. By rotating the rest around the axis 29 of rotation, the cutting arm 13, having not been swivelled, arrives at a position 13'', whereas the cutting arm, which has been swivelled into the position 13', can arrive at the position 13'''. In an analogous manner, the second cutting arm 14 can, by actuating the hydraulic cylinder-piston-aggregate 17, be swivelled into the position 14'. By rotating the non-swivelled cutting arm 14, this cutting arm arrives at the position 14'', whereas by rotating the cutting arm, which has been swivelled into the position 14', the position 14''' can be arrived at. As a whole, there results an excavating pattern composed of four concave areas which corresponds to an appreciable approximation to a plane mining face. By actuating the hydraulic cylinder-piston-aggregates 25, the carrier can, as a whole, be shifted in axial direction of the shield, i.e. in direction of the axis 30, so that the depth of penetration and the depth of cut can exactly be adjusted.

The shield is at times advanced in a manner known per se, for which purpose separate shield pressing cylinders are provided, the points of engagement of which are schematically indicated by reference numeral 31.

What is claimed is:

1. A shield-advancing cutting machine for advancing a shield in an advancing direction having a longitudinal axis, said machine comprising:

a generally cylindrical tubular shield having an inner circumferential surface and a leading circumferential edge;

means for axially advancing said shield in said advancing direction for maintaining proximity of said leading edge with a wall being mined;

a carrier means;

mounting said carrier means to said inner circumferential surface of said shield for selective movement along said longitudinal axis relative to said shield and for tilting movement relative to said longitudinal axis for providing said carrier means with a selectively varied angle of longitudinal axis inclination relative to said longitudinal axis of said shield;

a rest;

rotary drive means mounting said rest to said carrier means for selective rotary movement about the longitudinal axis of said carrier means;

a plurality of cantilever arms having rear ends pivotally mounted by swivel means to said rest so as to project axially forwards and radially outward from said rest;

control means mounted between each said cantilever arm and said rest for swiveling said arms about said swivel means;

said cantilever arms further having free forward ends provided with respective rotatable cutting heads, whereby said cantilever arms, when swivelled cause said rotatable cutting heads to be moved through respective arcs oriented generally transverse to said longitudinal axis of said carrier means;

said swivel axes of said rear ends of said cantilever arms being located at least two different distances radially away from said longitudinal axis of said carrier means; and said axes of movement of respective ones of said cutting heads intersecting one another.

2. The shield-advancing cutting machine of claim 1, wherein:

said rest comprises a radially extending plate fixed to an axially extending drive shaft;

said carrier means includes a support plate through which said drive shaft extends;

said rotary drive means comprises gear means on said drive shaft enmeshed with gear means on said support plate and motor means arranged in driving relation to at least one of said gear means; and said swivel means pivotally mount said rear end of said cantilever arms to cheek members provided on said radially-extending plate.

3. The shield-advancing cutting machine of claim 2, wherein:

said swivel means provide said rear ends of said cantilever arms with respective swivel axes disposed generally crosswise in relation to said longitudinal axis of said carrier means.

4. The shield-advancing cutting machine of claim 3, wherein:

said swivel axes of said rear ends of said cantilever arms are located at least two different distances radially away from said longitudinal axis of said carrier means.

5. The shield-advancing cutting machine of claim 1, wherein:

for each said cantilever arm, said cutting heads comprise two oppositely laterally-projecting mushroom-shaped cutting heads mounted for rotation about a common transversally-extending axis.

6. The shield-advancing cutting machine of claim 1, wherein:

said leading circumferential edge is inclined downwardly-rearwardly as seen in side elevation; and said carrier means mounting means is arranged for tilting said carrier means to such an extent that said longitudinal axes of said carrier means is approximately normal to said leading circumferential edge as seen in side elevation.

7. The shield-advancing cutting machine of claim 1, wherein:

said axis of movement of respective ones of said cutting heads intersect.

* * * * *